United States Patent [19]

Demarthe et al.

[11] Patent Number: 4,902,343

[45] Date of Patent: Feb. 20, 1990

[54] HYDROMETALLURGICAL PROCESS FOR THE TREATMENT OF SULPHIDIZED COMPOUNDS CONTAINING LEAD

[75] Inventors: Jean-Michel Demarthe, Viroflay; André Georgeaux, Rambouillet, both of France

[73] Assignee: Societe Miniere et Metallurgique de Penarroya, Trappes, France

[21] Appl. No.: 421,088

[22] Filed: Sep. 22, 1982

Related U.S. Application Data

[63] Continuation of Ser. No. 333,797, Dec. 23, 1981, abandoned, which is a continuation of Ser. No. 158,447, Jun. 11, 1980, abandoned, which is a continuation of Ser. No. 896,356, Apr. 14, 1978, abandoned, which is a continuation-in-part of Ser. No. 817,380, Jul. 20, 1977, abandoned.

[30] Foreign Application Priority Data

Jul. 20, 1976 [FR] France ..... 76 22138
Apr. 15, 1977 [FR] France ..... 77 11451

[51] Int. Cl.[4] ..... C22B 3/00

[52] U.S. Cl. ..... 75/101 R; 75/114; 75/117; 75/118 R; 75/120; 75/121; 204/107; 204/117; 423/38; 423/87; 423/92; 423/98; 423/150

[58] Field of Search ..... 75/77, 78, 104, 101 BE, 75/101 R, 114, 117, 120, 109, 121; 204/107, 117; 423/38, 87, 92, 61, 50, 98

[56] References Cited

U.S. PATENT DOCUMENTS

| | | | |
|---|---|---|---|
| 219,961 | 9/1879 | Lyte | 423/94 X |
| 507,130 | 10/1893 | Hoepfner | 204/107 |
| 704,639 | 7/1902 | Hoepfner | 75/117 |
| 935,337 | 9/1909 | Thwaites | 423/87 |
| 1,390,603 | 9/1921 | Christensen | 75/120 X |
| 1,528,716 | 3/1925 | Wigton | 75/120 |
| 1,539,713 | 5/1925 | Christensen | 75/120 |
| 1,549,063 | 8/1925 | Christensen | 75/114 |
| 1,588,806 | 6/1926 | Pike | 75/104 |

(List continued on next page.)

FOREIGN PATENT DOCUMENTS

| | | |
|---|---|---|
| 856829 | 1/1978 | Belgium . |
| 522906 | 2/1968 | France . |
| 2346456 | 4/1973 | France . |
| 2271298 | 5/1974 | France . |
| 136163 | 2/1964 | United Kingdom . |

OTHER PUBLICATIONS

Mellor, "Comprehensive Treatise on Inorganic & Theoretical Chemistry", vol. 7, Longmans, Green & Co., N.Y., 1927, pp. 712 & 713, QD 31.M4.

Zeft et al., *Chem. Zentralblatt* (1960), Seite 973,974.

*Primary Examiner*—Robert L. Stoll

*Attorney, Agent, or Firm*—Fleit, Jacobson, Cohn & Price

[57] ABSTRACT

The invention provides a hydrometallurgical process for recovering lead in essentially pure form from a sulphurized compound containing at least lead as a non-ferrous metal. The process involves treating the sulphurized compound with an aqueous lixiviating solution containing at least one chloride of a metal selected from the group consisting of copper, bismuth, antimony, arsenic, and silver, preferably cupric chloride, the quantity of said at least one chloride being less than or equal to that which is stoichiometrically required for the complete dissolution of the lead contained in the sulphurized compound, thereby to obtain a solution containing lead chloride and the chlorides of metals nobler than lead as impurities if originally present in the sulphurized lead compound, and an insoluble residue containing the sulphide of the metal of said at least one chloride, the sulphides of the non-ferrous metals originally present in the sulphurized compound, and free sulphur. The lead chloride solution is separated from the insouble residue, and purified by cementation with metallic lead or a more reducing metal than lead. Thereafter, the lead ions of the purified lead chloride solution are reduced to metallic lead which is recovered. The reduction may be accomplished by cementation with a more reducing metal than lead, preferably iron, or the reduction may be carried out by means of hydrogen.

23 Claims, 1 Drawing Sheet

U.S. PATENT DOCUMENTS

| | | | |
|---|---|---|---|
| 1,736,659 | 11/1929 | Mitchell | 75/111 |
| 2,021,896 | 11/1935 | Platten | 75/120 |
| 3,479,378 | 11/1969 | Orlandini et al. | 75/101 BE |
| 3,849,121 | 11/1974 | Burrows | 75/120 |
| 3,872,210 | 3/1975 | Ukaji | 423/561 |
| 3,961,941 | 6/1976 | Baker et al. | 75/120 |
| 3,998,628 | 12/1976 | Gandon et al. | 75/104 |
| 4,016,056 | 4/1977 | Demarthe et al. | 75/117 X |
| 4,023,964 | 5/1977 | Demarthe et al. | 75/101 R |
| 4,230,487 | 10/1980 | Demarthe et al. | 75/101 R |
| 4,276,084 | 6/1981 | Reynolds | 75/101 R |
| 4,288,304 | 9/1981 | Demarthe et al. | 204/111 |

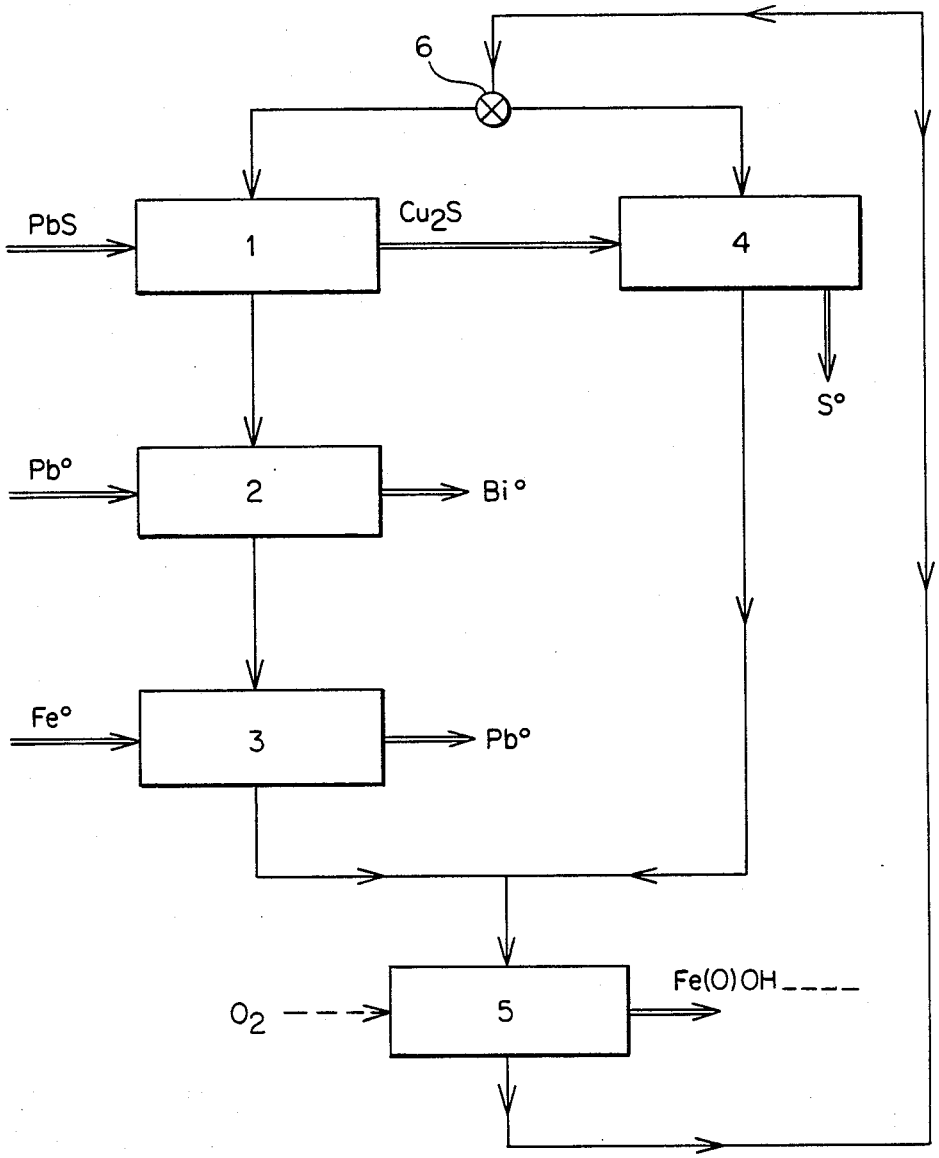
6
PbS
1
$Cu_2S$
4
S°
Pb°
2
Bi°
Fe°
3
Pb°
$O_2$
5
Fe(O)OH

HYDROMETALLURGICAL PROCESS FOR THE TREATMENT OF SULPHIDIZED COMPOUNDS CONTAINING LEAD

This application is a continuation of Ser. No. 333,797, filed Dec. 23, 1981, now abandoned, which in turn is a continuation of Ser. No. 158,447, filed Jun. 11, 1980, now abandoned, which is a continuation of Ser. No. 896,356, filed Apr. 14, 1978, now abandoned, which is a continuation-in-part of application Ser. No. 817,380, filed Jul. 20, 1977, now abandoned.

The present invention relates to a hydrometallurgical process for the treatment of sulphidized compounds containing lead. It relates more specifically to a process for selective solubilization of lead as compared to other non-ferrous metals contained in such sulphurized compounds and as compared to iron.

It is known that galena, or lead sulphide, is frequently disseminated in the natural state in other sulphides such as pyrite, blende, copper sulphide and, generally speaking, the sulphides of non-ferrous metals.

According to conventional metallurgical processes, the different sulphides forming part of the ore are separated by differential flotation, and then treated by conventional pyrometallurgical processes. Nevertheless, differential flotation does not always render it possible to obtain a perfect separation; the concentrates obtained being either concentrates as such, mixed concentrates, or concentrates of very impure lead in which the proportion of lead reaches no more than 40 or 50% instead of 60 to 80% as normal.

The concentrates mentioned above are all very difficult to process in accordance with the techniques developed in conventional metallurgy.

The processes described in U.S. Pat. Nos. 4,230,487 and 4,288,304, respectively, have brought a decisive advance in the field of complex ores and of flotation concentrates. The first of these applications describes a process for solubilization of the totality of the non-ferrous metals contained in a sulphurized compound by means of cupric chloride regenerated by means of air and of a regenerating agent which may be hydrochloric acid or ferrous chloride.

The processing of the solutions thus obtained, when they contain zinc, is described in the fourth application above cited. The latter specifies that lead may be separated from the other non-ferrous metals by precipitating its chloride by temperature reduction. The lead chloride obtained in this manner is very pure; in particular, it contains no more than small quantities of copper and silver the separation of which from lead is always difficult. The lead chloride may then be cemented by more reducing metals than itself, such as zinc or iron, for example.

Despite numerous advantages, this technique is sometimes costly and is not always very appropriate for the economic conditions of the working of the deposits of lead sulphide. More particularly, this method requires the presence of a plant for precipitation of lead chloride and has a heat balance which is not always favorable.

This is why it is one of the objects of the present invention to provide a method of treating sulphidized compounds containing lead by means of copper chloride which renders it possible to obtain a solution of lead chloride free of copper.

Another object of the present invention is to provide a process of the preceding type which is as selective as possible with respect to the other non-ferrous metals.

Another object of the present invention is to provide a method of processing the solution originating from this selective action.

Another object of the present invention is, finally, the provision of a process for the purification of the solutions of lead chloride.

In accordance with the invention, these objects and others which will emerge from the following description are accomplished by means of a hydrometallurgical process for the treatment of a sulphidized compound containing at least lead as a non-ferrous metal, characterized by the fact that the said sulphurized compound is placed in contact with an aqueous solution containing at least one chloride selected from the group of the chlorides of copper, bismuth, antimony, arsenic and silver, the quantity of the said chlorides placed in operation being smaller than or equal to that which is stoichiometrically required for the total dissolution of the lead contained in the sulphidized compound.

One of the principal applications of the present invention resides in the selective lixiviation of the lead contained in the sulphurized compound; in this case, it is preferable to select the cuprous and cupric chlorides.

By virtue of the presence of the copper in limited quantity during this lixiviation, the dissolution of the lead results not only from the action on its sulphide by cupric chloride to yield plumbous and cuprous chlorides, but also from an exchange between the cupric cations of the solution and the lead of the sulphidized compound.

Moreover, if the lixiviation is performed solely by means of copper chlorides, the stoichiometry is defined with respect to the two reactions as follows:

$$2Cu^{++}+PbS \rightarrow Pb^{++}+2Cu^{+}+S^{\circ}$$

and $$2Cu^{+}+PbS \rightarrow Pb^{++}+Cu_2S$$

or $$Cu^{++}+PbS \rightarrow Pb^{++}+CuS$$

The condition applicable to the quantity of cupric chloride placed in operation may, consequently, be expressed by the following inequality:

$$[Cu^{++}] + 2[Cu^{+}] \leqslant [Pb^{++}]$$

in which $[Cu^{++}]$ represents the quantity in moles of cupric copper placed in operation initially;

$[Cu^{+}]$ represents the quantity in moles of cuprous copper placed in operation initially; and $[Pb^{++}]$ represents the quantity of lead initially present in the sulphurized compound; that is to say, the quantity of lead liable to pass into solution.

The cupric chloride may be regenerated partially "in situ" or concomitantly with the dissolution according to the method specified in the aforementioned U.S. Pat. No. 4,230,487.

This regeneration, which may be performed "in situ" or in a separate reactor, consists in oxidizing the cuprous ions in the presence of hydrochloric acid and/or of ferrous chloride, the reactions involved in this regeneration being the following:

$$2\ CuCl + 2\ HCl + 1/2\ O_2 \longrightarrow 2\ CuCl_2 + H_2O$$

$$4\ CuCl + 2\ FeCl_2 + 3/2\ O_2 + H_2O \longrightarrow$$

$$4\ CuCl_2 + \underline{2\ Fe\ (O)\ OH} \downarrow$$

In case of regeneration, the condition applicable to the quantity of chlorides placed in operation may be expressed in the following manner: The quantity of chloride ions initially in the form of the chloride of copper, of bismuth, of antimony, of arsenic of silver, of ferrous iron and/or of hydrogen, should be smaller than or equal to that which would be in the form of lead chloride if all the lead present in the sulphurized compound were in the form of plumbous chloride. It is suitable that the first of the quantity of chloride in the form of cupric chloride and of regenerating agent (ferrous chloride and/or hydrochloric acid), is not lower than 3% or better than 50%.

The selective lixiviation may fulfill two requirements: either obtaining a sulphidized compound containing practically no lead, or else obtaining directly as pure a lead chloride solution as possible.

In the first case, it is preferable to lixiviate with as great a quantity of copper chloride as possible.

At this point of the specification, it is appropriate to point out that the expression "equal to the stoichiometrical quantity" should not be understood as an equality within the strict meaning of the term. Whilst remaining within the scope of the process in accordance with the invention, it is thus possible to lixiviate with an excess of the chloride of copper, bismuth, antimony and/or of silver, which may reach 10 and even 20%. This latter value represents a maximum, however.

In the second case, it is preferable to lixiviate with a quantity of chloride amounting rather to less than the stoichiometrical quantity, the chloride selected advantageously being cupric chloride.

The lixiviation may be performed at a temperature higher than ambient temperature, preferably between 60° C. and the boiling point of the reactive mixture.

Depending on the dissolving capacity of the aqueous lixiviating phase, the lead chloride may be obtained in the form of a solution or of a pulp of lead chloride.

In the first case, to ensure the retention in solution of the lead chloride, the concentration of chloride ions of the aqueous phase is advantageously at least equal, disregarding the chlorides assuring the lixiviation, to 1 gram-equivalent per liter of chloride ions, and may preferably be greater than 4 gram-equivalents per liter.

These chloride ions may be fed into the aqueous phase in the form of ammonium chloride, of alkali metal chlorides, or of alkaline earth metal chlorides, and, generally speaking, in the form of any metal chloride dissociated in an aqueous phase.

In the second case, as set forth in our French addition patent application No. 77-11451, filed Apr. 15, 1977, the lead chloride is recovered in the form of pulp. To this end, it is sufficient for the quantity of lead to be lixiviated per unit of volume to be greater than the capacity of dissolution of the lixiviating solution.

What is thus obtained after lixivitation is, on the one hand, a saturated lead chloride solution as a liquid phase and possible containing a small quantity of zinc chloride, and, on the other hand, two solid phases, one constituted of lead chloride, and the other of copper sulphides, essentially being cupric sulphide, sulphides of metals the chloride of which has been applied to act on the lead sulphide, and metal sulphides which had not reacted with the attacking solution.

The applicants made the surprising finding that the appearance of a third phase, crystallised lead chloride, does not in any way impede the attacking reaction and this despite the fact that the crystals of plumbous chloride are very dispersed, are very intimately mixed with the sulphides, and tend to cover the particles of ore or of concentrate.

One of the principal advantages of this second embodiment is that it permits the application of concentrated copper chloride solutions such as those in which the copper concentration is at least equal to 30 g/l, or 0.5 M.

To avoid increasing the solubility of the lead chloride, the concentration of free chloride ions, disregarding the chlorides assuring the lixiviation, is advantageously equal to at most 2 and preferably comprises between 0.5 and 1.5 gram-equivalents per liter. The chloride ions may be introduced in the form of wholly or partially dissociated chlorides. In this latter case, allowance should be made for the part of the chloride which is not dissociated, and is thus not free, in the determination of the quantity of chlorides to be added.

The solid mixture emerging from the action should undergo a treatment for separating the lead chloride from the residual sulphides.

To this end, recourse may be had to the physical treatment currently applied in metallurgy during the production of concentrates from ores. Without going into exhaustive detail, flotation, separation in a dense medium, and elutriation, may be mentioned.

Another possibility is to cement the solid mixture into a pulp by means of a metal more reducing than lead, such as iron or zinc, thus obtaining metallic lead which may be separated from the sulphide phase by resorting to one of the physical separation techniques mentioned above. The pulp may be either the reactive mixture after attack, or may originate from the conversion into pulp of the cake obtained after filtering and possibly washing of the reactive mixture.

A third possibility is to take up again the cake of lead chloride and sulphide obtained after filtering, and possibly washing, of the reactive mixture in a solution of dissociated metal chloride, to dissolve the lead chloride and to separate the same from the other solids.

Some of the above procedures are illustrated by Examples 8–10 hereinafter:

The pH value is advantageously maintained between 0 and 3 in all instances.

The lixiviation may be applied in a moving bed or in several consecutive reactors, the sulphidized compound moving in counterflow to the attacking solution.

The preliminary placing in contact of the sulphidized compound with cupric or ferric chloride activates the ore, that is to say, distinctly increases the selectivity and speed of the lixiviation. In a first stage, this placing in contact modifies the surface condition, and in a second stage modifies the sulphur concentration of the sulphidized compound by dissolving a part of the lead. It is self-evident that this favourable modification may equally be obtained while having sulphur in the residual mixture. Since cupric chloride forms part of the chlorides liable to lixiviate lead selectively, it is preferred to ferric chloride.

It will be observed that a lixiviation making use of cupric chloride renders it possible simultaneously to activate the ore and to perform the selective lixiviation as such.

The selectivity obtained by the application of the present invention is the more remarkable in that it is exercised with respect to less reducing metals than lead, such as bismuth, silver and antimony, as well as with respect to more reducing metals such as zinc or iron and with respect to metalloids such as, bismuth, antimony, arsenic and even copper which count among the most troublesome impurities of lead and should be eliminated from a lead solution if it is wished to perform a direct cementation. The process of the present application thus renders it possible to selectively lixiviate the lead contained in a sulphurized compound by means of its own impurities. A novel application of the present invention is deduced from this finding: the process may equally be applied to eliminate particular impurities such as, for example, silver, bismuth, antimony, arsenic and copper, from the impure lead chloride solutions.

It is appropriate to state that the facility of absorption of these impurities by the ore varies with the concentration of cupric ions of the solution which is to be purified. The purities obtained are wholly remarkable. Advantageously the amount of cupric chloride is at least equal to one time or preferably to three times the sum of other selective chlorides, i.e. silver, cuprous, copper, bismuth, antimony and arsenic chlorides. It is appropriate to state that, in this treatment, the lead contained in the ore should be in greater quantity than that which is required stoichiometrically to precipitate these impurities in the form of sulphides. This purifying technique is well suited to lead chloride solutions originating from an attack by ferric chloride.

The lead contained in the form of chloride in the solution thus obtained may be recovered according to all the methods already described, such as for example those disclosed in the aforementioned U.S. Pat. No. 4,288,304.

The techniques which render it possible to obtain the cupric chloride regeneration agents directly or indirectly, that is to say hydrochloric acid and/or ferrous chloride, are preferable, however.

Among the methods capable of providing regenerating agents, it is possible to cite the cementation by means of iron which yields ferrous chloride, or of zinc which yields zinc chloride which may be at least partly pyrohydrolysed into zince oxide or stychloride and hydrochloric acid, and the reduction of lead chloride by means of hydrogen. Throughout the present application, "cementation" should be understood as meaning not only cementation as such, but also its technical equivalents. As an example of a technical equivalent of cementation, it is appropriate to cite soluble anode electrolysis, the metal forming the anode being different from that it is wished to recover. It is equally possible to mention the cells of the "Daniell cell" type. This latter may actually be analysed as a cementation of copper by means of zinc. In these two cases, the electrodes may be separated by a partition permeable to chloride ions.

Iron, in particular in the form of pre-reduced iron, is the metal preferred for performing the cementation of lead.

As regards the reduction by means of hydrogen, it may be performed in accordance with the general technique for reduction of metal chlorides by means of hydrogen known as the "van Arkel process".

It is equally possible to resort to the novel technique described in the French addition patent No. 76-28912 to Bernard Lambert, filed Sept. 24, 1976, in which the lead chloride, obtained after the attacking action, is recovered in crystallised form, for example, by cooling of the solution charged with lead chloride, after which the lead chloride is melted and then reduced by means of hydrogen, with the reduction of the molten lead chloride being advantageously performed at a temperature between approximately 700° and 950° C., and preferably between 850° C. and 950° C. In this process, the reaction may be performed at different pressures, but for reasons of a practical nature, however, it is preferred that the reduction be carried out at atmospheric pressure. The hydrogen may be applied either pure, or diluted in an inert gas, such as nitrogen or a rare gas.

One of the preferred forms of application of this Lambert reduction process involves melting the lead chloride and blowing hydrogen into the bath by means of lances. The hourly rate of flow of hydrogen should preferably exceed approximately twice the stoichiometrical quantity required to reduce the totality of the lead chloride, the stoichiometry corresponding to the following reduction:

$$PbCl_2 + H_2 \rightarrow Pb^{\circ} + 2HCl$$

The gases emerging from the reduction consequently contain, on the one hand, the fraction of hydrogen which has not reacted and, on the other hand, the hydrochloric acid formed during the reaction. The hydrogen may be burnt to heat the lead chloride, and the hydrochloric acid, mixed with the hydrogen, being apt either to be separated prior to combustion or recovered thereafter. The hydrogen may equally be recycled to the reduction of lead chloride after having been separated from the hydrochloric acid in accordance with conventional techniques such as gaseous diffusion or cooling followed by absorption in water.

This application on an industrial scale of hydrogen to reduce the molten lead chloride according to the Lambert process simultaneously represents a surprise to one versed in the art and a teaching of special interest for the industrialist. As a matter of fact, the thermodynamic calculations demonstrate that the reaction is very difficult, the standard free enthalpy variations ($\Delta$ G) being greater than or equal to zero at the different temperatures contemplated, as may be seen from the following table:

| Temperature | $\Delta G$ kilocalories/mole |
|---|---|
| 900° C. | 0 |
| 827° C. | +4 |
| 527° C. | +11 |

The calculations of the enthalpy variations shown above were carried out on the basis of the tables and graphs published in "The Thermochemical Properties of the Oxides, Fluorides and Chlorides to 2500° K", by Alvin Glassner—Report ANL (Argonne National Laboratory)—5107.

The sulphidized residue originating from the purification or from the lixiviation and containing (1) the sulphide of the metal of the chloride employed in the lixiviating solution, e.g., copper, bismuth, antimony, arsenic and silver, (2) the sulphides of the non-ferrous metals less noble than lead which were originally present in the starting sulphurized compound, and (3) free sulphur may be processed in such manner as to recover the non-ferrous metals it contains. The techniques specified in U.S. Pat. Nos. 4,230,497, 4,288,304, 4,016,056 and 4,023,964, are particularly appropriate and the subject matter of all these U.S. patents is incorporated herein by reference. Thus, when the sulphidized residue is treated according to the process of U.S. Pat. No. 4,016,056, the sulphidized residue is subjected to the following procedure:

(a) lixiviation with an aqueous solution containing cupric chloride formed in situ, at least in part, by oxidation, by introducing hydrochloric acid and air into the cuprous chloride solution resulting from lixiviation;

(b) partial extraction of the copper contained in the lixiviation solution resulting from stage (a) by contacting the lixiviation solution with an organic extractant containing a cationic solution, the extraction being accompanied by oxidation by injecting air into the lixiviation solution;

(c) re-extraction of the copper contained in the organic extractant by contacting the organic extractant with an aqueous solution of sulphuric acid and recycling the organic extractant to the extraction stage (b); and (d) electrolysis of the copper sulphate solution obtained in stage (c) to yield copper and an aqueous solution of sulphuric acid which is recycled to the reextraction stage (c), at least part of the aqueous solution, which results from the partial copper extraction stage (b), being recycled to the lixiviation stage (a) and constituting a part of the cupric chloride solution, the other part of the aqueous solution being treated to recover the useful metals and the hydrochloric acid that it contains. This procedure is particularly applicable when the starting sulphidized residue is rich in copper.

When the sulphidized residue is treated according to the process of U.S. Pat. No. 4,230,487 the sulphidized residue is subjected to the following procedure:

(a) lixiviation at a temperature above 50° C. with an aqueous solution containing cupric chloride and an agent for solubilizing cuprous chloride, whereby the metal sulphides are converted to the respective soluble metal chlorides, the cupric chloride is reduced to cuprous chloride which remains in solution due to said solubilizing agent, and elemental sulfur is produced;

(b) regeneration of the resulting reaction mixture in situ at atmospheric pressure and at a temperature above 50° C. with air and hydrochloric acid while maintaining the pH of the solution at a value not exceeding 1 when the solution contains ferrous chloride and at a value not exceeding 3 when ferrous chloride is absent, whereby the cuprous chloride is oxidized to cupric chloride; and (c) recovery of an aqueous solution containing the non-ferrous metal chlorides.

As a variation of this procedure, the elemental sulphur and any unreacted residue is separated from the reaction mixture before regeneration, and the resulting solution, containing at least 1 g/l of cuprous ions and at least 2 g/l of ferrous ions, is regenerated with air and ferrous chloride at a pH between 1 and 3 whereby goethite is precipitated from the solution and separated therefrom, the iron being recovered therefrom is desired, and the aqueous solution containing the non-ferrous metal chlorides is recovered.

When the sulphidized residue is treated according to the process of French application No. 577,659, filed May 15, 1975, which has since matured into U.S. Pat. No. 4,023,964, granted May 17, 1977), the sulphidized residue is subjected to the following procedure:

(a) lixiviation with an aqueous solution containing cupric chloride;

(b) separation of the resulting solution into two parts with the first of said two parts of the solution, containing at least 1 g/l of cuprous ions and at least 2 g/l of ferrous ions, being subjected to oxidation by air at atmospheric pressure at a pH between 1 and 3, and at a temperature above 90° C. whereupon goethite is precipitated and separated and the iron recovered therefrom if desired, the resulting aqueous solution then being recycled to the lixiviation stage (a);

(c) partial extraction of the copper contained in the second of said two parts of the solution by contacting said solution with an organic phase containing a cationic agent, said partial extraction being accompanied by oxidation by the injection of air, the major portion of the resulting aqueous phase being recycled to the lixiviation stage (a);

(d) re-extraction of the copper contained in said organic phase by contacting the latter with an aqueous sulphuric acid solution thereby to obtain an aqueous copper sulphate solution, and recycling the organic phase to the partial extraction stage (c); and (e) treating the aqueous copper sulphate solution from step (d) to obtain, on the one hand, elemental copper, and on the other hand, an aqueous sulphuric acid solution which is recycled to re-extraction stage (d). This procedure is particularly applicable when the starting sulphidized residue is rich in copper.

When the sulphidized residue is treated according to the process of French application No. 75-12373 (which corresponds to U.S. patent application Ser. No. 677,515, filed Apr. 16, 1976), the sulphidized residue is subjected to the following procedure:

(a) lixiviation with an aqueous solution of cupric chloride, which can be regenerated by means of a regenerating agent and air;

(b) extraction of the zinc contained in the lixiviation solution by contacting the lixiviation solution by means of an organic phase containing a solvent comprising an acidic organophosphorus compound; and (c) recovery of the zinc contained in said organic phase after said extraction by elution. This procedure is particularly applicable when the starting sulphidized material is rich in zinc, copper, and silver. After recovery of the zinc, the copper may be recovered by cementation or by liquid-liquid extraction, and the silver may be recovered by cementation or by selective electrolysis.

The utilization of the process in accordance with the present invention renders it possible to improve and/or extend the sphere of application of the processes described in the patents cited above. As a matter of fact, these processes may make use of the ferrous chloride produced during the cementation of the lead for the regeneration of the cupric chloride, and may provide the solutions of chlorides required for lixiviation.

BRIEF DESCRIPTION OF THE DRAWING

The following description is not of a restrictive nature in any way. It is simply intended to convey a clear grasp of how the teachings of the present application may be applied in practice, and it should be read with reference to the single figure in the accompanying drawing which, in a very diagrammatical manner, shows how the process of the invention may be applied to a sulphized compound containing lead.

In this figure, the circuits of the solids are illustrated by means of a double line and those of the liquids by means of a single line.

With reference to the figure, the sulphurized compound containing lead is fed into a selective attack reactor 1 where it is placed in contact with a solution of copper chloride the origin of which will be specified subsequently.

The lead chloride solution thus obtained is conveyed into a cementation plant 2 while the sulphurized residue is conveyed into another attack reactor 4 where it is placed in contact with a solution of cupric chloride and in which the totality of the non-ferrous metals it contains is placed in solution.

In the cementation plant 2, the lead chloride solution is placed in contact with metallic lead or with a more reducing metal than lead, the residual impurities nobler than lead then being precipitated in metallic form.

The lead chloride solution emerging from the plant 2 is conveyed into a cementation plant 3 in which it is placed in contact with a more reducing metal than lead, preferably with iron.

The lead then precipitates in metallic form while the iron passes into solution in the form of ferrous chloride.

The ferrous chloride solution emerging from plant 3 is mixed with the solution of chlorides of the non-ferrous metals emerging from reactor 4 and is conveyed into a plant 5 for regeneration of the cupric chloride by bubbling of air or of a gas containing oxygen, the ferrous chloride being precipitated in the form of geothite according to the reaction:

$$4\,Cu^{++} + 2\,FeCl_2 + H_2O + 3/2\,O_2 \longrightarrow 4\,Cu^{++} + \underline{2\,FeO\,(OH)} + 4\,Cl^-$$

Supplementary quantities of ferrous chloride and possibly of hydrochloric acid may equally be fed into the plant.

The solution of cupric chloride thus recovered is separated into two parts by means of a system of valves 6, the first part being conveyed into the reactor 1 in such quantity that the dissolution of the lead is selective, and second part being conveyed into the reactor 4 for placing the totality of the non-ferrous metals in solution.

It is appropriate to note that the arsenic, as well as a part of the bismuth and of the antimony which are possibly placed in solution, are eliminated during the stage of precipitation of goethite, the first in the form of ferric arsenate, the second ones in the form of the oxychlorides.

One versed in the art will equally realize how easy it is to incorporate a scheme of this kind in one of the processes described in U.S. Pat. Nos. 4,230,487, 4,288,304, 4,023,964, 4,016,056, and 3,998,628, and how much it improves them.

Consequently, if reference is made to the figures U.S. Pat. No. 4,023,964, and to plants A and E of U.S. Pat. No. 4,288,304, respectively, to the plants 2 and 6 of FIG. 1 of French patent application No. 74-16,774, and to the plants A and E of the French patent application No. 75-12,373.

The following non-limiting examples have for their purpose to enable specialists to determine, easily, the operating conditions it is appropriate to apply in each particular case.

EXAMPLE 1

Lixiviation of a lead concentrate by means of cupric chloride ($CuCl_2$) with dissolution of the lead and precipitation of the copper A volume of 6.00 liters of a solution containing 250 g/l of sodium chloride and 9.76 g/l of copper in the form of cupric chloride is maintained at a temperature of 80° C. in a spherical flask equipped with a heating system and topped by a rising cooler.

428.2 g of a finely crushed lead concentrate analyzed at 45.1% of lead and 5.83% of zinc in the form of sulphides, is then fed in at once. The solid and liquid aggregate is shaken vigorously for two hours. At the end of this period, the contents of the flask are filtered, and a balance is drawn up of the different components, as follows:

| Description | Weight (g) or volume (ml) | Zn g/l % | Total Zn g | Cu g/l % | Total Cu g | Pb g/l % | Total Pb g |
|---|---|---|---|---|---|---|---|
| initial lead concentrate | 428.2 | 5.83 | 26.0 | 1.42 | 6.1 | 45.1 | 193.1 |
| initial solution | 6000 | 0.06 | 0.36 | 9.76 | 58.6 | 0.02 | 0 |
| total of the materials fed in | | | 26.36 | | 64.7 | | 193.1 |
| final solution | 5800 | 0.72 | 4.18 | 1.82 | 10.6 | 81.1 | 180.4 |
| final solid | 270.7 | 7.95 | 21.5 | 20.6 | 55.8 | 3.0 | 8.1 |
| total of the emergent materials | | | 25.68 | | 66.4 | | 188.5 |
| yield of dissolution % | | | 16.3 | | | | 95.7 |

This example clearly illustrates the fact that it is possible to place almost the whole of the lead in solution, together with the precipitation of the copper into the solid.

EXAMPLE 2

Exhaustion of the attack residue 1 and recovery of the precipitated copper

Two liters of a solution of cupric chloride analyzed at 9.08 g/l of copper are kept at 80° C. in a glass reactor topped with a rising cooler. 27.2 grams of the final solid obtained at the end of the preceding experiment, is then fed in at once. The whole is stirred in homogenous manner for two hours, the cuprous ion concentration reaching 6.35 g/l during this period.

At the end of the experiment, the aqueous phase is separated from the solid by filtering and analytical determination are performed which render it possible to draw up the following balance of materials:

| Description | Weight (g) or volume (ml) | Zn g/l % | Total Zn g | Cu g/l % | Total Cu g | Pb g/l % | Total Pb g |
|---|---|---|---|---|---|---|---|
| initial solution | 2000 | 0.06 | 0.12 | 9.08 | 18.16 | 0.01 | 0 |
| incoming solid | 27.2 | 7.95 | 2.16 | 20.6 | 5.6 | 3.0 | 0.82 |
| total input | | | 2.28 | | 23.76 | | 0.82 |
| final solution | 2000 | 0.72 | 1.44 | 11.54 | 23.1 | 0.54 | 1.08 |
| final solid | 17.3 | 4.52 | 0.78 | 1.92 | 0.33 | 0.35 | 0.06 |
| total output | | | 2.22 | | 23.41 | | 1.14 |

This experiment shows that the second attack renders it possible to recover the copper precipitated during the first attack, and to place in solution a large proportion of the zinc and of the lead which were not dissolved during the selective attack. If the chemical composition of the residue from the second attack is compared to the initial composition of the ore, it is observed that the overall yield of dissolution of the metals for the two attacks is:

| | |
|---|---|
| zinc | 68.9% |
| lead | 99.7% |
| copper | 45.9% |

The recovery of close to half of the copper initially present in the concentrate is thus added to the total redissolution of the copper precipitated during the selective attack.

EXAMPLE 3

Purification by a lead chloride solution of precipitation of the impurities

This experiment is performed on an aliquot part of the solution obtained in the experiment of Example 1. 4 grams of lead powder is added in one batch to 500 ml of this solution kept at 80° C. and stirred vigorously. The stirring is continued for 70 minutes. At the end of this period, a solid-liquid separation is undertaken by filtering, to draw up the analytical balance of the behaviour of the impurities as follows:

| Description | Weight (g) or volume (ml) | Zn g/l % | Cu g/l % | Pb g/l % | As g/l % | Bi g/l % | Ag g/l % | Sb g/l % |
|---|---|---|---|---|---|---|---|---|
| initial solution | 500 | 0.72 | 1.82 | 31.1 | 0.118 | 0.01 | 0.045 | 0.01 |
| initial lead powder | 4 | | | 100 | | | | |
| final solution | 500 | 0.59 | 0.026 | 32.0 | 0.032 | 0.005 | 0.002 | 0.01 |

It is observed that at the end of this operation, the solution is denuded of the principal impurities liable to be entrained in a subsequent cementation of the lead. These impurities accumulate in the previous cement, this being the case in particular of copper, of bismuth and partially of arsenic.

EXAMPLE 4

Cementation of the lead by means of iron sponge from a solution of plumbous chloride ($PbCl_2$) in a brine The solution originating from the pre-cementation reported in Example 3, above, is taken again for this experiment.

4.3 grams of iron sponge crushed beforehand to a grain size between 80 and 200 microns is added to 420 ml of this solution. This iron sponge analyzed 72.4% of metallic iron. The operation is performed while stirring vigorously at a temperature of 80° C. for 100 minutes.

At the end of the operation, a solid-liquid separation is performed, and an analytical balance is drawn up of the incoming and outgoing materials, as follows:

| Description | Weight (g) or volume (ml) | Zn g/l % | Cu g/l % | Pb g/l % | Fe g/l % | As g/l % | Bi g/l % | Ag g/l % | Sb g/l % |
|---|---|---|---|---|---|---|---|---|---|
| precemented solution | 450 | 0.59 | 0.03 | 32.0 | | 0.032 | 0.01 | 0.005 | 0.005 |
| iron sponge | 4.3 | | | | 97.0 | | | | |
| final solution | 400 | 0.58 | 0.04 | 9.76 | 5.94 | 0.003 | 0.01 | 0.001 | 0.01 |
| final cement | 11.6 | 0.014 | 0.11 | 79.5 | 11.0 | not determined | 0.02 | 0.0025 | 0.005 |

EXAMPLE 5

Dissolution of lead by means of cuprous chloride (CuCl) brine

Two liters of a solution titered at 16.5 g/l of cuprous ions and 22.1 g/l of copper as a whole, are fed into a cylindrical reactor. While the solution is kept at 80° C., consecutive fractions of lead concentrate are fed in.

After each infeed of concentrate, the stabilization of the concentration of cuprous ions is awaited before proceeding with another addition of ore. This procedure is followed until the complete disappearance of the cuprous ions. The results are summarized in the following table:

| Description | Weight (g) or volume ($cm^3$) | Zn g/l % | Total Zn g | Cu g/l % | Total Cu g | Pb g/l % | Total Pb g | As g/l % | Total As g | Bi g/t | Total Bi g | Ag g/t | Total Ag g |
|---|---|---|---|---|---|---|---|---|---|---|---|---|---|
| initial concentrate | 410.9 | 5.83 | 24.0 | 1.42 | 5.8 | 45.1 | 185.3 | 0.36 | 1.5 | 403 | 0.17 | 738 | 0.3 |

-continued

| Description | Weight (g) or volume ($cm^3$) | Zn g/l % | Total Zn g | Cu g/l % | Total Cu g | Pb g/l % | Total Pb g | As g/l % | Total As g | Bi g/t | Total Bi g | Ag g/t | Total Ag g |
|---|---|---|---|---|---|---|---|---|---|---|---|---|---|
| initial solution | 2000 | 0.08 | 0.16 | 22.1 | 44.2 | 0.2 | 0.4 | — | — | — | — | — | — |
| total input | — | — | 24.16 | — | 50.0 | — | 185.7 | — | 1.5 | — | 0.17 | — | 0.3 |
| final solution | 2000 | 2.76 | 5.52 | 5.28 | 10.56 | 15.4 | 30.8 | — | — | — | — | — | — |
| residue (damp) | 443 | 4.25 | 18.8 | 8.65 | 38.3 | 35 | 155.1 | 0.34 | 1.5 | 384 | 0.17 | 619 | 0.27 |
| total output | — | — | 24.32 | — | 48.86 | — | 185.9 | — | 1.5 | — | 0.17 | — | 0.27 |
| dissolution yield % | — | — | 22.3 | — | — | — | 16.6 | — | 0 | — | 0 | — | 10 |

N.B. The true yield of lead chlorination is actually higher, a part of the $PbCl_2$ remaining within the residue as a consequence of the saturation of the solution.

It is appropriate to note the selectivity of the attack with respect to bismuth, silver and arsenic.

EXAMPLE 6

Influence of the temperature: attack of the ore by cuprous chloride (CuCl) at boiling point The reduced solution is raised to the boiling point before feeding in the ore. Boiling is maintained for 5 hours.

The following table gives the results of this operation:

| Description | Weight (g) or volume ($cm^3$) | Zn | Total Zn | Cu | Total Cu | Pb | Total Pb |
|---|---|---|---|---|---|---|---|
| initial solution | 500 | 0.04 | 0.02 | 17.9 | 8.95 | 50.02 | 0 |
| fresh concentrate | 32.3 | 5.83 | 1.88 | 1.42 | 0.46 | 45.10 | 14.57 |
| total input | — | — | 1.90 | — | 9.41 | — | 14.57 |
| final solution | 500 | 1.12 | 0.56 | 12.88 | 6.44 | 10.52 | 5.26 |
| residue (estimated weight) | 26 | 5.15 | 1.34 | 12.7 | 3.30 | 30.4 | 7.90 |
| total output | | | 1.90 | | 9.74 | | 13.16 |
| dissolution yield % | | | 29.5 | | | | 40.0 |

EXAMPLE 7

Tests for activation of the ore by means of cupric chloride ($CuCl_2$)

The ore is initially exposed to an activation at 80° C., by means of a solution of cupric chloride analyzed at approximately 18 g/1 of copper for 15 minutes. The quantity of cupric chloride placed in operation is equal to 31.7% of the stoichiometrical quantity (QS) required to place the lead in solution.

A solution of CuCl is then fed into the reactor in such volume that the lead initially fed in exceeds 1.1 QS with respect to the total quantity of $Cl^-$ ions linked to the copper which are introduced.

The results obtained are summarized in the following table:

| Description | Weight (g) or volume ($cm^3$) | Zn | Total Zn | Cu | Total Cu | Pb | Total Pb |
|---|---|---|---|---|---|---|---|
| activating solution | 90 | — | — | 18.5 | 1.67 | — | — |
| attacking solution | 410 | 0.12 | 0.05 | 22.3 | 9.14 | 0.02 | 0 |
| fresh concentrate | 38 | 5.83 | 2.22 | 1.42 | 0.54 | 45.10 | 17.12 |
| total input | — | — | 2.27 | — | 11.35 | — | 17.12 |
| final solution | 480 | 0.82 | 0.39 | 8.6 | 4.13 | 18.9 | 9.07 |
| residue | 30.2 | 5.85 | 1.77 | 16.4 | 4.95 | 24.9 | 7.52 |
| total output | — | — | 2.16 | — | 9.08 | — | 16.59 |
| yield % | — | — | 18.1 | — | — | — | 54.7 |

Note will be taken of the improvement of the yield and of the selectivity with respect to zinc.

The following Examples 8–10 are illustrative of the process as carried out according to the disclosure of our French addition patent No. 11451, filed Apr. 15, 1977.

EXAMPLE 8

Attack within a pulp of a lead concentrate originating from Aznallcollar (Spain)

1762 grams of lead concentrate is fed into 4 liters of cupric chloride solution containing 54 grams of copper per liter, which corresponds to 85% of the stoichiometrical quantity required to convert the totality of the lead present in the ore into plumbous chloride. After one and a half hours of reaction, the reaction mixture is filtered to yield a filtrate and a cake the analysis of which, together with that of the ore, are presented in the following table:

| Element | Ore | Cake | Filtrate |
|---|---|---|---|
| Lead | 47% | 33.4% | 11.1 g/l |
| Zinc | 4.94% | 3.98% | 1.38 g/l |
| Copper | 0.96% | 9.10% | <0.02 g/l |
| Iron | 13.4% | not determined | 1.46 g/l |
| Silver | 768 g/T | not determined | not determined |
| Chloride | not determined | 11.2% | not determined |

It may equally be stated that the lead chloride yield amounts to approximately 80% with respect to the ore, and to 95% as compared to the copper chloride placed in operation at the beginning, and that the rate of zinc dissolution amounts to no more than 6%, which demonstrates the very great selectivity of the attack.

This experiment illustrates the possibility of chlorinating a lead concentrate while operating with a high proportion of solid and with a short dwell period.

EXAMPLE 9

Dissolution of lead chloride contained in a chlorination concentrate 20 liters of a brine originating from previous experiments and containing the following elements:

| | |
|---|---|
| NaCl | 256 g/l |
| Pb | 4.5 g/l |
| Zn | 0.22 g/l |
| Cu | 0.24 g/l |

are kept at 90° C. in a 20-liter reactor.

2,000 g of a homogenized solid originating from a variety of chlorination experiments are then fed into the reactor in one batch. The composition of this product is the following:

| | |
|---|---|
| Pb | 33.5% |
| Cl | 8.73% |
| Zn | 3.24% |
| Fe | 9.94% |
| Cu | 9.24% |
| $H_2O$ | 10.0% |

The dissolution of lead chloride as a function of time is shown in the following table:

| Time (min.) | Zn (g/l) | Cu (g/l) | Pb (g/l) |
|---|---|---|---|
| 0 | 0.22 | 0.24 | 4.5 |
| 5 | 0.26 | 1.0 | 19.9 |
| 10 | 0.26 | 1.0 | 23.1 |
| 20 | 0.30 | 1.0 | 26.3 |
| 40 | 0.28 | 1.0 | 26.6 |
| 90 | 0.30 | 0.94 | 26.0 |

These experiments render it possible to observe the speed of the dissolution of lead chloride, since equilibrium is reached at the end of 20 minutes, and 70% of this equilibrium is obtained at the end of 5 minutes. The copper which had been precipitated during the previous attacks remains practically insoluble.

EXAMPLE 10

Attack of a chlorination residue by means of HCl and air

This experiment was performed in a 20-liter cylindrical reactor equipped with a special stirring system. As a matter of fact, this stirring system is actually a flotation impeller normally designed to perform ore enrichments. An impeller of this type has the feature of assuring intimate contact between the gas and the mixture, thanks to a satisfactory dispersion of the gas, and to a substantial recirculation of the volume of gas present above the level of the liquid.

20 liters of solution having the following composition:

| | |
|---|---|
| Pb | <0.2 g/l |
| Cu | 16.6 g/l |
| Zn | 41.6 g/l |
| Fe | 0.2 g/l |

are heated to 80° C. in a reactor of this kind.

1,100 g of a solid composed of an ore which had consecutively undergone the two operations of chlorination and of redissolution of $PbCl_2$ and then decanted, are introduced as a single batch into the reactor. This solid has the following composition:

| | |
|---|---|
| Pb | 2.61% |
| Cu | 18.7% |
| Zn | 6.84% |
| Fe | 19.2% |
| $H_2O$ | 10% |

Compressed air is fed into the mixture at a rate of flow of 1240 l/h, the pH being maintained between 1.5 and 2 by the addition of 6N HCl. A solid-liquid separation is undertaken at the end of 10½ hours. After having been washed with distilled water, the residual solid weighs 764 g, and its chemical composition is:

| | |
|---|---|
| Pb | 0.45% |
| Cu | 0.99% |
| Zn | 1.75% |
| $H_2O$ | 16.6% |

Based on this analysis, it is possible to calculate the rate of dissolution of the elements present initially in the solid which are as follows:

| | |
|---|---|
| Pb | 88.0% |
| Cu | 96.3% |
| Zn | 82.2% |

Consequently, it is observed that it is possible to recover the copper precipitated during the chlorination stage in a satisfactory yield, while assuring the recovery of the residual Pb and Zn.

The following Examples 11–14 illustrate the invention utilizing hydrogen reduction according to French addition patent No. 76-28912 to Bernard Lambert.

EXAMPLE 11

Elimination of the impurities accompanying the lead by crystallization of lead chloride The purpose of this example is to demonstrate the high degree of purity of lead chloride which may be obtained by crystallization.

An impure solution of lead chloride is filtered and then allowed to stand for 48 hours. The initial and final temperature of the solution are 85° C. and 16° C., respectively. The crystals obtained are separated by filtration.

Analyses of the initial solution and of the crystals obtained are shown in the following table:

| Description | Weight or volume | Pb g/l % | Cu g/l % | Fe g/l % | Zn g/l % | Bi g/l % | Ag g/l % | Sb g/l % | As g/l % | Sn g/l % |
|---|---|---|---|---|---|---|---|---|---|---|
| initial | 850 l | 23.2 | 2.02 | 0.22 | 1.32 | 0.028 | 0.044 | 0.034 | 0.02 | 0.003 |

-continued

| Description | Weight or volume | Pb g/l % | Cu g/l % | Fe g/l % | Zn g/l % | Bi g/l % | Ag g/l % | Sb g/l % | As g/l % | Sn g/l % |
|---|---|---|---|---|---|---|---|---|---|---|
| solution | | | | | | | | | | |
| crystals | 13.5 kg | 74.4 | 0.015 | 0.07 | 0.005 | 0.009 | 0.002 | 0.02 | 0.014 | 0.012 |

The purity obtained is of the order of 99.9%.

Operating Method of Examples 12, 13 and 14

80 g of slightly damp lead chloride corresponding to 56 g of metallic lead are melted in a quartz tube. Hydrogen is caused to bubble into the molten chloride bath by means of a quartz pipe.

The height of the molten chloride amounts to approximately 5 cms prior to reduction.

The operating parameters and the results of the different examples are summarized in the following tables:

EXAMPLE 12

| | |
|---|---|
| Temperature | 800° C. |
| Period | 1 hour |
| Hydrogen flow rate | 30 1/hr |
| Weight of the residual slag ($PbCl_2$) | 0 g |
| Weight of the reduced lead | 56 g |
| Yield | 100% |

An identical result is obtained if the hydrogen is replaced by a hydrogen-nitrogen mixture containing 50% of hydrogen the rate of flow of the gaseous mixture being equal to 30 1/hr, the reaction period being increased to two hours, and the other conditions remaining unchanged.

EXAMPLE 13

| | |
|---|---|
| Temperature | 800° C. |
| Period | 1 hour |
| Hydrogen flow rate | 15 1/hr |
| Weight of the residual slag ($PbCl_2$) | 31 g |
| Weight of the reduced lead | 35 g |
| Yield | 64% |

EXAMPLE 14

| | |
|---|---|
| Temperature | 700° C. |
| Period | 1 hour |
| Hydrogen flow rate | 30 1/hr |
| Weight of the residual slag ($PbCl_2$) | 36 g |
| Weight of the reduced lead | 28 g |
| Yield | 52% |

The lead purity obtained exceeds 99.99%: the proportion in the lead obtained in its different impurities is summarized in the following table:

| Impurity | Proportion in g/T |
|---|---|
| arsenic (As) | 60 |
| antimony (Sb) | 30 |
| copper (Cu) | 2 |
| tin (Sn) | 2 |
| silver (Ag) | traces (limits of detection) |
| bismuth (Bi) | traces (limits of detection) |
| zinc (Zn) | traces (limits of detection) |

EXAMPLE 15

Purification of lead chloride solution

An impure lead chloride solution is continuously contacted with fresh lead concentrate in two twenty liters reactors working co-currently. The operating conditions are the following:

average size of the concentrate granules: 200 micrometers;

concentrate flow-rate: 788 g/hour;

lead chloride solution flow-rate: 20 liters/hour;

pH: 1.7;

temperature: 90° C.; and residence time: 2 hours.

The results of this purification are given in the following table:

| | Composition of the concentrate (in percent) | Composition of the impure solution (in g/l) | Composition of the purified solution (in g/l) | Composition of the emergent solid (in percent) |
|---|---|---|---|---|
| Lead (Pb) | 64.3 | 13.7 | 28.3 | 25.2 |
| Zinc (Zn) | 4.48 | 6.3 | 6.9 | 6.1 |
| Copper (Cu) | 0.42 | 4.0 | 0.00153 | 97.8 |
| Iron (Fe) | 4.83 | 1.0 | 3.1 | 6.8 |
| Silver (Ag) | 0.0919 | 0.04 | <0.002 | 0.34 |
| Sulphur (S) | 18.0 | — | — | 27.0 |
| Bismuth (Bi) | 0.030 | 0.02 | 0.006 | 0.14 |
| Arsenic (As) | 0.090 | 0.034 | <0.002 | 0.14 |
| Antimony (Sb) | 0.31 | 0.018 | <0.002 | 0.52 |
| Sodium chloride | — | 250 | 250 | — |

This example proves that it is possible to obtain a very good purification by contacting impure lead chloride solution with ore or concentrate containing galena. Such purity allows direct electrolysis (with soluble or insoluble anode) of the purified lead chloride solution to recover metallic lead. It is also to be noted that ferrous chloride does not impede the purification of lead chloride dissolved in concentrated chloride solution (more than 2N) by contacting fresh galena.

What is claimed is:

1. A process for obtaining lead chloride from sulfide ores containing lead sulfide comprising:

(a) leaching the ore with an aqueous solution containing cupric chloride under reaction conditions of temperature, time, pH, total copper concentration and total chloride ion concentration selected so as to convert a substantial portion of the lead sulfide to lead chloride while leaving the remainder of the ore substantially unreacted and wherein the cupric chloride leach solution does not solubilize all of the lead chloride so that a portion of the lead chloride precipitates from the leach solution; and (b) separating solids comprising lead chloride, unreacted ore, sulfur and gangue from the leach solution.

2. A process for separating lead chloride from sulfide ores containing lead sulfide comprising:

(a) leaching the ore with an aqueous solution containing cupric chloride under reaction conditions of temperature, time, pH, total copper concentration and total chloride ion concentration selected so as to convert a substantial portion of the lead sulfide to lead chloride while leaving the remainder of the ore substantially unreacted and wherein the cupric chloride leach solution does not solubilize all of the lead chloride formed so that a portion of the lead chloride precipitates from the leach solution;

(b) separating solids comprising lead chloride, unreacted ore, sulfur and gangue from the leach solution;

(c) subjecting the separated solids to a brine leach with a solution of dissociated metal chlorides in order to substantially solubilize the lead chloride to the exclusion of the other solids;

(d) separating the brine leach solution containing the solubilized lead chloride from the solids; and (e) separating the lead chloride from the brine leach solution separated in step (d).

3. The process of claim 1 or claim 2 wherein the cupric chloride leach solution solubilizes about 6.8 percent of the lead chloride formed.

4. The process of claim 1 or claim 2 wherein the cupric chloride of the leach solution of step (a) is regenerated with a source of oxygen.

5. The process of claim 4 wherein the cupric chloride leach solution separated in step (b) is recycled back to step (a).

6. The process of claim 1 or claim 2 wherein the cupric chloride leach of the ore is conducted at a temperature higher than ambient and a pH between 0 and 3 and wherein the cupric chloride leach solution contains at least 30 grams of copper in solution per liter of the leach solution.

7. The process of claim 6 wherein the chloride ion concentration is maintained by the addition of an alkali metal chloride in an amount equal to at most 2 gram-equivalents per liter of chloride.

8. A process of forming lead chloride from sulfide ores containing lead sulfide comprising:

(a) leaching the ore with an aqueous solution containing cupric chloride and saturated with lead chloride at a temperature higher than ambient and a pH between 0 and 3, wherein the cupric chloride leach solution contains at least 30 grams of copper in solution per liter of each solution, wherein the cupric chloride leach solution has a chloride ion concentration maintained by the addition of an alkali metal chloride in an amount equal to at most 2 gram-equivalents of chloride per liter of leach solution, so as to convert a substantial portion of the lead sulfide to lead chloride while leaving the remainder of the ore substantially unreacted;

(b) separating solids comprising lead chloride, unreacted ore, sulfur and gangue from the leach solution.

9. A process for separating lead chloride formed from sulfide ores containing lead sulfide comprising:

(a) leaching the ore with an aqueous solution containing cupric chloride and saturated with lead chloride at a temperature higher than ambient and a pH between 0 and 3, wherein the cupric chloride leach solution contains at least 30 grams of copper in solution per liter of leach solution, and wherein the cupric chloride leach solution has a chloride ion concentration maintained by the addition of an alkali metal chloride in an amount equal to at most 2 gram-equivalents of chloride per liter of leach solution, so as to convert a substantial portion of the lead sulfide to lead chloride while leaving the remainder of the ore substantially unreacted;

(b) separating solids comprising lead chloride, unreacted ore, sulfur and gangue from the leach solution;

(c) subjecting the separated solids to a brine leach with a solution of dissociated metal chlorides in order to substantially solubilize the lead chloride to the exclusion of the other solids;

(d) separating the brine leach solution containing the solubilized lead chloride from the solids; and (e) separating the lead chloride from the brine leach solution separated in step (d).

10. The process of claim 9 wherein the brine leach of step (c) contains 256 grams of sodium chloride per liter.

11. The process of claim 8 or claim 9 wherein the cupric chloride contained in the leach solution of step (a) is regenerated with a source of oxygen.

12. A process of forming lead chloride from sulfide ores containing lead sulfide comprising:

(a) leaching the ore with an aqueous solution containing cupric chloride and saturated with lead chloride at a temperature higher than ambient and a pH between 0 and 3 wherein the cupric chloride leach solution contains at least 30 grams of copper in solution per liter of leach solution and wherein the cupric chloride leach solution has a chloride ion concentration maintained by the addition of sodium chloride in an amount equal to at most 2 gram-equivalents of sodium chloride per liter of leach solution, so as to convert a substantial portion of the lead sulfide to lead chloride while leaving the remainder of the ore substantially unreacted; and (b) separating the solids comprising lead chloride, unreacted ore, sulfur and gangue from the leach solution.

13. A process of separating lead chloride formed from sulfide ores containing lead sulfide comprising:

(a) leaching the ore with an aqueous solution containing cupric chloride and saturated with lead chloride at a temperature higher than ambient and a pH between 0 and 3, wherein the cupric chloride leach solution contains at least 30 grams of copper in solution per liter of leach solution and wherein the cupric chloride leach solution has a chloride ion concentration maintained by the addition of sodium chloride in an amount equal to at most 2 gram-equivalents of sodium chloride per liter of leach solution, so as to convert a substantial portion of the lead sulfide to lead chloride while leaving the remainder of the ore substantially unreacted; and (b) separating the solids comprising lead chloride, unreacted ore, sulfur and gangue from the leach solution;

(c) subjecting the separated solids to an aqueous brine leach containing 256 grams of sodium chloride per liter of leach in order to substantially solubilize the lead chloride to the exclusion of the other solids;

(d) separating the brine leach solution containing the solubilized lead chloride from the solids; and (e) crystallizing the lead chloride from the separated brine leach solution of step (d).

14. A process for obtaining lead chloride from sulphide ores containing lead sulfide comprising:

(a) leaching the ore with an aqueous solution containing cupric chloride under reaction conditions selected so as to convert a substantial portion of the lead sulphide to lead chloride while leaving the remainder of the ore substantially unreacted and wherein the cupric chloride leach solution does not solubilize all of the lead chloride so that a portion of the lead chloride precipitates from the leach solution; and (b) separating solids comprising lead chloride, unreacted ore, sulphur and gangue from the leach solution.

15. A process for separating lead chloride from sulphide ores containing lead sulphide comprising:

(a) leaching the ore with an aqueous solution containing cupric chloride under reaction conditions selected so as to convert a substantial portion of the lead sulphide to lead chloride while leaving the remainder of the ore substantially unreacted and wherein the cupric chloride leach solution does not solubilize all of the lead chloride formed so that a portion of the lead chloride precipitates from the leach solution;

(b) separating solids comprising lead chloride, unreacted ore, sulphur and gangue from the leach solution;

(c) subjecting the separated solids to a brine leach with a solution of dissociated metal chlorides in order to substantially solubilize the lead chloride to the exclusion of the other solids;

(d) separating the brine leach solution containing the solubilized lead chloride from the solids; and (e) separating the lead chloride from the brine leach solution separated in step (d).

16. A hydrometallurgical process for recovering lead from a sulphurized compound containing at least lead as a non-ferrous metal, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound as said lead chloride and to form said precipitate, said aqueous lixiviating solution containing at least 4 gram-equivalents of chloride ions per liter, said chloride ions being introduced into the said aqueous lixiviating solution by addition of at least one chloride selected from the group consisting of ammonium chloride, an alkali metal chloride, and an alkaline earth metal chloride.

17. A hydrometallurgical process for recovering lead from a sulphurized compound containing at least lead as a non-ferrous metal, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound as said lead chloride and to form said precipitate, the quantity of lead to be lixiviated per unit of volume being greater than the dissolving capacity of the aqueous lixiviating solution such that a portion of the formed lead chloride remains undissolved, the copper concentration of the aqueous solution being at least equal to 30 g/1.

18. A hydrometallurgical process for recovering lead from a sulphurized compound containing at least lead as a non-ferrous metal, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound as said lead chloride and to form said precipitate, the quantity of lead to be lixiviated per unit of volume being greater than the dissolving capacity of the aqueous lixiviating solution such that a portion of the formed lead chloride remains undissolved, and exposing the solid mixture of lead chloride and of sulphides, obtained after filtration of the reaction mixture, to a physical separation technique to separate the lead chloride from the sulphides.

19. A hydrometallurgical process for recovering lead from a sulphurized compound containing at least lead as a non-ferrous meta, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound of said lead chloride and to form said precipitate, and quantity of lead to be lixiviated per unit of volume much greater than the dissolving capacity of the aqueous lixiviating solution such that a portion of the formed lead chloride remains undissolved, and exposing the undissolved lead chloride to a cementation by means of a metal selected from the group consisting of iron and zinc.

20. The process of claim 19 wherein the metallic lead, obtained after cementation, is separated from the sulphides by a physical separation technique.

21. A hydrometallurgical process for recovering lead from a sulphurized compound containing at least lead as a non-ferrous metal, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound as said lead chloride and to form said precipitate, the quantity of lead to be lixiviated per unit of volume being greater than the dissolving capacity of the aqueous lixiviating solution such that a portion of the formed lead chloride remains undissolved, and wherein the mixture of lead chloride and sulphides, obtained after filtration of the reaction mixture, is returned into the state of pulp and cemented by means of a metal selected from the group consisting of iron and zinc.

22. A hydrometallurgical process for recovering lead from a sulphurized compound containing at least lead as a non-ferrous metal, comprising contacting said sulphurized compound with an aqueous lixiviating solution containing at least one chloride of a metal selected from the group consisting of copper, bismuth, antimony, arsenic, and silver to form a solution containing lead chloride and to form a precipitate containing the sulphide of the metal of said at least one chloride, the quantity of said at least one chloride in said aqueous lixiviating solution being less than or about equal to the stoichiometric quantity required to completely dissolve the lead contained in the sulphurized compound as said lead chloride and to form said precipitate, the quantity of lead to be lixiviated per unit of volume being greater than the dissolving capacity of the aqueous lixiviating solution such that a portion of the formed lead chloride remains undissolved, and the solid mixture, obtained after filtration of the reaction mixture, is redissolved in a solution of dissociated metal chloride to yield a solution of lead chloride and a solid phase composed of sulphides.

23. A hydrometallurgical process for recovering lead in essentially pure form from a sulphurized compound containing at least lead as a non-ferrous metal, comprising:

(a) treating said sulphurized compound with an aqueous lixiviating solution containing at least copper chloride, the quantity of said copper chloride being less than or equal to that which is stoichiometrically required for the complete dissolution of the lead contained in the sulphurized compound, thereby to obtain a solution containing lead chloride and the chlorides of metals nobler than lead as impurities if originally present in the sulphurized lead compound, and a first insoluble residue containing the sulphide of copper, the sulphides of all non-ferrous metals originally present in the sulphurized compound, and free sulphur;

(b) separating the lead chloride solution from the first insoluble residue;

(c) reducing the lead ions of the lead chloride solution obtained in step (b) to metallic lead and recovering the lead;

(d) treating the first insoluble residue, obtained in step (a) and containing copper sulphide, the sulphides of the other non-ferrous metals which may have originally been present in the sulphurized compound, and free sulphur, with cupric chloride solution to solubilize all the non-ferrous metals which may be present therein to obtain a solution containing the chlorides of all the non-ferrous metals including cuprous chloride, separating the free sulphur from the chloride solution of the non-ferrous metals, treating the resulting mixture with a regenerating agent selected from the group consisting of oxygen, air, hydrochloric acid, and ferrous chloride thereby to regenerate the cupric chloride and precipitate, as a second insoluble residue, the iron as goethite, together with any arsenic, where present, as ferric arsenate, and bismuth and antimony, where present, in the form of their oxychlorides, separating the solution containing the regenerated cupric chloride from the second insoluble residue, recycling a portion of said cupric chloride solution to step (a), mixing said portion of said cupric chloride solution recycled to step (a) with the resulting solution obtained in step (a) to serve as lixiviating solution and recycling the remainder of the solution for solubilizing the non-ferrous metals contained in the first insoluble residue.

* * * * *